US009360842B2

(12) United States Patent
Neboisa et al.

(10) Patent No.: US 9,360,842 B2
(45) Date of Patent: Jun. 7, 2016

(54) MECHANISM FOR SELECTING AND ACTUATING FUNCTIONS OF A CLOCKWORK MOVEMENT

(71) Applicant: GFPI SA, La Chaux-de-Fonds (CH)

(72) Inventors: Christophe Neboisa, Schüpfen (CH); Stephen Forsey, Les Brenets (CH)

(73) Assignee: GFPI SA, La Chaux-de-Fonds (CH)

( * ) Notice: Subject to any disclaimer, the term of this patent is extended or adjusted under 35 U.S.C. 154(b) by 0 days.

(21) Appl. No.: 14/782,771

(22) PCT Filed: Apr. 3, 2014

(86) PCT No.: PCT/EP2014/056653
§ 371 (c)(1),
(2) Date: Oct. 6, 2015

(87) PCT Pub. No.: WO2014/166798
PCT Pub. Date: Oct. 16, 2014

(65) Prior Publication Data

US 2016/0124388 A1 May 5, 2016

(30) Foreign Application Priority Data

Apr. 8, 2013 (CH) ..... 0736/13

(51) Int. Cl.
*G04B 27/02* (2006.01)
*G04B 27/04* (2006.01)
(Continued)

(52) U.S. Cl.
CPC ..... *G04B 27/026* (2013.01); *G04B 3/046* (2013.01); *G04B 27/004* (2013.01); *G04B 27/04* (2013.01); *G04B 27/02* (2013.01)

(58) Field of Classification Search
CPC ..... G04B 3/046; G04B 27/004; G04B 27/02; G04B 27/026; G04B 27/046
USPC ..... 368/190–194
See application file for complete search history.

(56) References Cited

U.S. PATENT DOCUMENTS 3,798,893 A 3/1974 Ippoushi
5,299,177 A * 3/1994 Koch ..... G04C 3/14 368/28

(Continued)

FOREIGN PATENT DOCUMENTS

CH 348365 A 8/1960
CH 702 803 A2 9/2011

(Continued)

OTHER PUBLICATIONS

International Search Report mailed Oct. 13, 2014, issued in corresponding International Application No. PCT/EP2014/056653, filed Apr. 3, 2014, 3 pages.

*Primary Examiner* — Vit W Miska
(74) *Attorney, Agent, or Firm* — Christensen O'Connor Johnson Kindness PLLC

(57) ABSTRACT

The present application relates to a mechanism for selecting and actuating n functions of a clock movement, where n is an integer no lower than 1, preferably no lower than 2, more preferably no lower than 3, including a winding mechanism rod ending in a crown, a device for actuating a function, said device being kinematically connected to the crown and arranged such as to move and assume n selection positions and n actuation positions in which the actuation device is kinematically connected to an actuation member of the selected function, and a selecting device arranged such as to move the actuation device into a selection position. Said mechanism further includes a base onto which the actuation device is moveably mounted such as to be moved and positioned, by the selecting device, into a selection position facing the actuation member of the selected function, and such as to be moved, by an axial movement of the winding mechanism rod, into the actuation position thereof in order to engage with said actuation member of the selected function.

16 Claims, 9 Drawing Sheets

(51) Int. Cl.
*G04B 3/04* (2006.01)
*G04B 27/00* (2006.01)

(56) References Cited

U.S. PATENT DOCUMENTS 6,295,249 B1 * 9/2001 Takahashi ..... G04B 27/06 368/190
6,499,874 B2 * 12/2002 Graemiger ..... G04B 27/04 368/190
7,441,945 B2 * 10/2008 Laucella ..... G04B 3/048 368/190
8,439,558 B2 * 5/2013 Pittet ..... G04B 27/04 368/192
2003/0151984 A1 * 8/2003 Speichinger ..... G04B 27/001 368/190
2008/0159081 A1 7/2008 Laucella
2009/0010109 A1 1/2009 Graemiger

FOREIGN PATENT DOCUMENTS

EP 1 939 699 A1 7/2008
EP 2 012 199 A2 1/2009
EP 2 214 066 A1 8/2010
EP 2 367 074 A1 9/2011
FR 2169861 A1 9/1973

* cited by examiner

MECHANISM FOR SELECTING AND ACTUATING FUNCTIONS OF A CLOCKWORK MOVEMENT

TECHNICAL FIELD

The present invention relates to timepieces. It more particularly relates to a mechanism for selecting and actuating n functions of a clockwork movement, where n is an integer greater than or equal to 1, preferably greater than or equal to 2, more preferably greater than or equal to 3, comprising a winding stem ending with a crown, a device for actuating a function, kinematically connected to the crown and arranged to move and occupy n selecting positions and n actuating positions, in which the actuating device is kinematically connected to an organ for actuating the selected function, and a selector device arranged to move the actuating device into a selecting position. The present invention also relates to a mechanical timepiece comprising a clockwork movement and a mechanism for selecting and actuating n functions of said clockwork movement.

BACKGROUND OF THE INVENTION

Such a selection and correction mechanism is for example described in patent EP 2 214 066 and applies to a timepiece provided with first and second time indicating organs. This correction mechanism comprises a winding stem, a corrector wheel mounted sliding between first and second correction positions in which said wheel is kinematically connected with the first and second time indicating organs, respectively, means for driving said corrector wheel using the winding stem, and a mechanism for selecting the correction position comprising a selector arm cooperating with said corrector wheel to drive it from the first correction position to the second correction position, an angular positioning organ of the selector arm and a control organ of said angular positioning organ.

However, due to its construction, this mechanism is limited to correcting only two functions.

Also known is application CH 702 548, which describes a selection mechanism capable of being in a neutral position or moving between two correction positions by pressing on the winding crown, the correction being done solely by rotating the winding crown, without having to pull on the winding stem. To that end, the mechanism comprises a lever having two arms, on each of which a correction wheel is mounted. The lever pivots to select and actuate one or the other of the two functions to be corrected using one of the correction wheels placed in contact with an organ of the function to be corrected. However, if the neutral position is not taken into account in which the lever is in the neutral position, this mechanism, due to its construction, is limited to correcting only two functions, the lever only being able to pivot between two positions.

Also known is application CH 702 803, which describes a correction mechanism comprising correction levers arranged to increment the counting organs, a control lever mounted pivoting along a first rotation axis and an arm mounted pivoting on said control lever along a second rotation axis. The arm moves angularly relative to the control lever in response to a rotation of the crown to be placed across from either of the correction levers. The control lever pivots to actuate the selected correction lever in response to an action on a push-piece. The correction therefore can only be done by incrementing the various counting organs, which makes bidirectional operation impossible. Only unidirectional correction of the counting organs is possible. Furthermore, this mechanism comprises a large number of components, which are relatively complex to implement. Such a solution, which only uses levers and cams, risks being fairly imprecise, the precision of the components (cams, arms, correction levers) being crucial for the system to operate correctly. Furthermore, the linear guiding of one of the levers is done through a groove in which a guide finger moves. The system is relatively sensitive to adjust and may create blockages.

One aim of the present invention is therefore to offset these drawbacks by proposing a mechanism for selecting and actuating n functions of a clockwork movement making it possible to select and actuate at least three different functions of a clockwork movement.

Another aim of the present invention is to propose a mechanism for selecting and actuating n functions of a clockwork movement making it possible to actuate the functions bidirectionally.

BRIEF DESCRIPTION OF THE INVENTION

To that end, and according to the present invention, proposed is a mechanism for selecting and actuating n functions of a clockwork movement, where n is an integer greater than or equal to 1, preferably greater than or equal to 2, still more preferably greater than or equal to 3, comprising a winding stem ending with a crown, a device for actuating a function, kinematically connected to the crown and arranged to move and occupy n selecting positions and n actuating positions, actuating positions in which the actuating device is kinematically connected to an organ for actuating the selected function, and a selector device arranged to move the actuating device into a selecting position.

According to the invention, said mechanism further comprises a base on which the actuating device is movably mounted to move and be positioned, in a selecting position, facing the organ for actuating the selected function under the action of the selector device, and to move into its actuating position to cooperate with said organ for actuating the selected function under the action of axial movement of the winding stem.

Particularly advantageously, the actuating device comprises a single actuating wheel kinematically connected to the winding stem and intended to cooperate with each of the organs for actuating the selected function.

Preferably, the actuating device may further optionally comprise at least one intermediate wheel arranged to cooperate on the one hand with the winding stem and on the other hand with said actuating wheel, a support on which said intermediate wheel and the actuating wheel are rotatably mounted, and a pivoting base arranged to cooperate with the selector device and on which the support is slidingly mounted.

Preferably, said support can be arranged to cooperate with a lever.

Advantageously, the selector device may comprise a selector organ arranged to be actuated by a control organ, a cam secured to said selector organ and a feeler-spindle arranged to cooperate on the one hand with the cam and on the other hand with the actuating device.

Preferably, the feeler-spindle may comprise an arm arranged to cooperate with the base of the actuating device.

Advantageously, said control organ may be a push-piece integrated into the crown.

Particularly advantageously, said base may have at least n tracks arranged to guide the actuating device during its movements. The actuating device may comprise a first pin arranged to travel in the tracks. The base may further comprise a groove and the actuating device may comprise a second pin arranged to travel in the groove.

Particularly advantageously, the mechanism according to the invention may further comprise a safety device comprising said base and said tracks, at least n of said tracks corresponding to the actuating positions being arranged to lock the actuating device in the selected actuating position.

Preferably, the mechanism according to the invention further comprises a mechanism for indicating the selected function.

Advantageously, said indicator mechanism of the selected function comprises a wheel secured to the cam of the selector device, and a disc bearing information relative to the functions and arranged to be displayed in an aperture, said wheel and said disc being kinematically connected.

According to one preferred embodiment of the invention, the functions to be selected are chosen from among the group comprising a date correction function, a winding function and a setting function.

The present invention also relates to a timepiece comprising a clockwork movement, as well as a mechanism for selecting and actuating n functions of said clockwork movement as defined above.

BRIEF DESCRIPTION OF THE DRAWINGS

The invention will be better understood upon reading the following description of embodiments, provided as examples and done in reference to the drawings, in which.

DETAILED DESCRIPTION OF THE INVENTION

Figure 1:
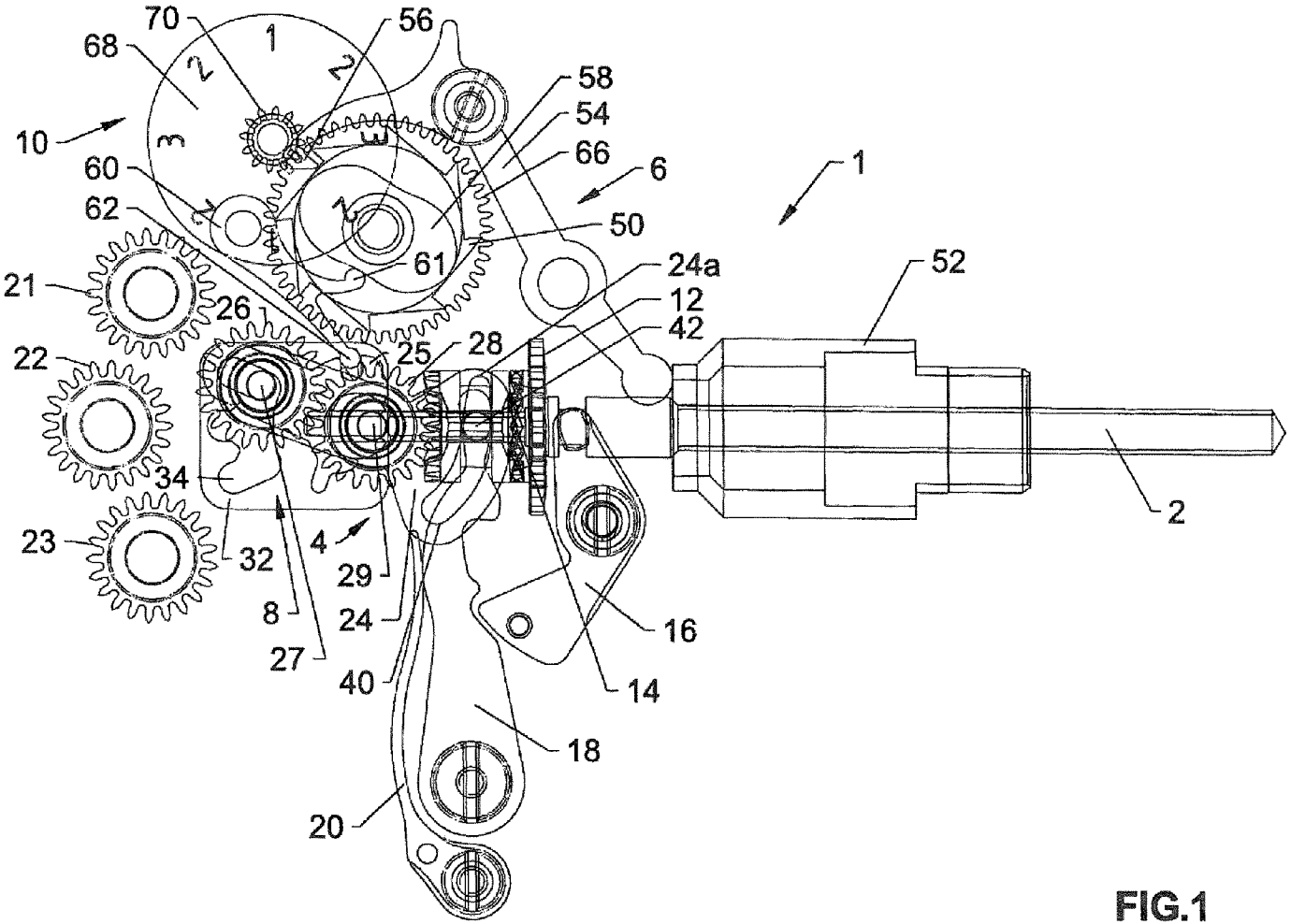
FIG. 1 shows a transparent bottom view of the mechanism according to the invention, in the position for selecting the first function.

In reference to FIG. 1, a mechanism 1 is shown for selecting and actuating n functions of a clockwork movement, n being equal to 3 in this specific embodiment. Of course, the invention applies to a correction mechanism preferably having at least two functions, and still more preferably at least 3 functions.

The mechanism 1 comprises a winding stem 2 ending with a winding crown (not shown), a device for actuating a function 4, a selector device 6, a safety device 8 and a mechanism indicating the selected function 10.

The mechanism 1 also comprises a winding-pinion 12, a clutch-pinion 14, the positioning of the clutch-pinion 14 being assured by a pull-out piece 16 and a lever 18. A lever return spring 20 is also provided. All of these elements and their operation are known by those skilled in the art and do not require a more detailed description.

Furthermore, organs are also provided for actuating the selected function 21, 22 and 23, each being kinematically connected to the mechanism corresponding to said selected function.

The functions to be selected may for example be chosen from the group comprising a date correction function, a winding function and a setting function. Of course, any other mechanism corresponding to another function may be actuated using an appropriate actuating organ.

The actuating device 4 is kinematically connected to the crown and arranged to move and occupy 3 selecting positions and 3 actuating positions, the selecting positions being different from the actuating positions. In selecting positions, the actuating device 4 is positioned facing the actuating organ 21, 22, 23 for the selected function without being able to cooperate with said actuating organ 21, 22, 23. In actuating positions, the actuating device 4 is kinematically connected to one of the actuating organs 21, 22, 23 for the selected function.

More particularly and according to the invention, the mechanism further comprises a base 32 on which the actuating device 4 is rotatably and translatably mounted to rotate and be positioned, in a selecting position, facing the actuating organ 21, 22, 23 for the selected function under the action of the selector device 6, then to move into its actuating position to cooperate with said actuating organ 21, 22, 23 for the selected function under the action of an axial movement of the winding stem 2, preferably toward the outside of the movement. Of course, by adapting the configuration of the stem, the pull-out piece and the lever, the axial movement of the winding stem could be done toward the inside of the movement.

More specifically, the actuating device 4 comprises a support 24, as well as a pivoting base 25, between which a single actuating wheel 26 designed to cooperate with each of the actuating organs 21, 22 and 23 for the selected function and an intermediate wheel 28 meshing on the one hand with the clutch-pinion 14, and therefore the winding stem 2, and on the other hand with said actuating wheel 26, are rotatably mounted. Thus, the actuating wheel 26 is kinematically connected to the winding stem 2 such that each of the actuating organs is actuated by rotating the crown connected to the winding stem 2. The actuating wheel 26 is mounted rotatably around a pin 27 mounted crossing through the support 24 and the pivoting base 25. The intermediate wheel 28 is mounted rotatable around a pin 29 mounted passing through the support 24.

Furthermore, the safety device 8 comprises a base 32 mounted fixed on the frame of the movement and having, in illustrated variant, three semi-oblong tracks 34 communicating with one another and able to receive the pin 27 when the actuating device 4 is in its actuating position so as to lock it in one of said tracks 34. Of course, the base may also be in a single piece with the main plate, a plate or a bar provided in the movement.

The base 32 also includes a split blom stud 33 having a central groove 36 in which the pin 19 can travel when the actuating device 4 enters the actuating position, as will be described below.

As more specifically shown in FIG. 2, the pivoting base 25 comprises a rounded part 25*a* arranged to pivot around the split blom stud 33 and an elongated part 25*b* including, at its end, an oblong opening 30 in which the pin 27 is inserted and slides when the actuating device 4 goes to the actuating position, as will be described below. Thus, the support 24 bearing the two wheels 26 and 28 is mounted sliding on the pivoting base 25.

As a result, the actuating device 4 is mounted rotatably and translatably relative to the base 32.

Furthermore, the rounded part 25*a* of the pivoting base 25 includes a lateral hollow 38 arranged to cooperate with the selector device 6 and form a ball-joint connection, as will be described below.

On the side of the winding stem, the support 24 comprises a head 24*a* including a circular groove 40 in which a pin 42 secured to the lever 18 travels. The support 24 is thus arranged to cooperate with the lever 18 while being able to pivot relative to the latter.

Figure 2:
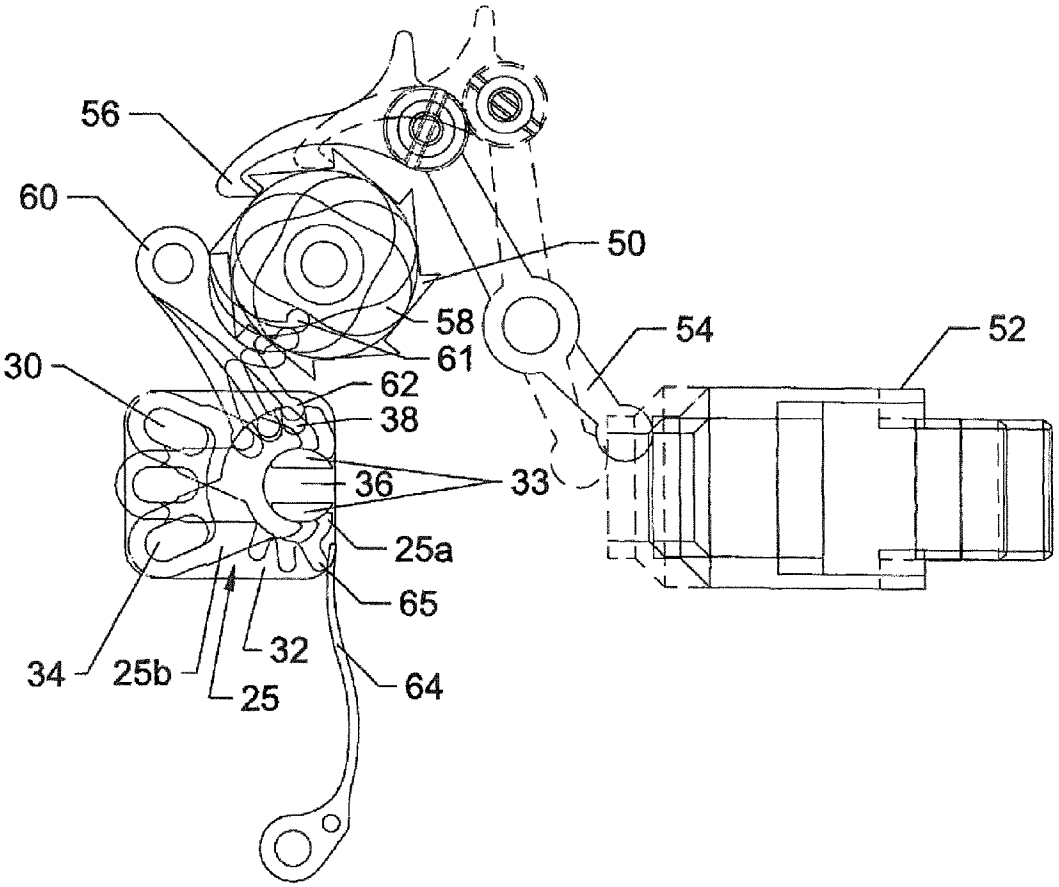
FIG. 2 shows a top view of the selector device and the safety device used in a mechanism according to the invention, in the three selecting positions.

In reference to FIGS. 1 and 2, the selector device 6 comprises a selector organ 50, such as a cam wheel, arranged to be actuated by a control organ, such as a push-piece 52 integrated into the crown, for example. The action of the push-piece 52 is transmitted to the selector organ 50 by means of a lever 54 mounted pivoting on the frame and comprising a beak 56 arranged to actuate and pivot the selector organ 50 each time the push-piece 52 is pressed. Of course, the control organ may be any other appropriate organ, such as a trigger or a secondary crown, arranged to rotate the selector organ 50. The controller may also be independent of the crown, and be provided around the dial, in a place different from that of the winding stem.

In another alternative embodiment that is not shown, the push-piece and the present winding stem could be replaced by a three-position stem ending with a crown and arranged to be positioned:

- in a position T0, in which the stem is pushed, the rotation of the crown allowing winding of the movement,
- in a position T1, in which the stem is pulled in the first position, the mechanism being suitable so that the rotation of the crown drives the rotation of the selector organ to move the actuating device into its selecting position,
- in a position T2, in which the stem is pulled into a second position to move the actuating device into its actuating position, the rotation of the crown driving the actuating of the actuating organ 21 to 23 selected via the intermediate wheel 28 and the actuating wheel 26.

The selector device 6 also comprises a cam 58 secured to the selector organ 50 and a feeler-spindle 60 arranged to cooperate on the one hand with the cam 58 and on the other hand with the actuating device 4. To that end, the feeler-spindle 60 comprises a first arm 61 that bears against the cam 58 and a second arm 62 mounted in a ball-joint connection with the hollow 38 of the pivoting base 25 of the actuating device 4, such that said second arm 62 cooperates with said base 25. The first arm 61 is kept bearing against the cam 58 via a return spring 64 acting against a catch 65 provided on the pivoting base 25.

The selector organ 50 and the shape of the cam 58 are chosen so that said selector organ 50 and said cam 58 perform a 45° rotation each time the push-piece is pushed. In the illustrated variant, the functions are selected in order, the reverse order having to be respected to return to the initial function. Of course, by choosing another configuration of the lever 54, the selector organ 50 and the push-piece 52 in particular, the rotation angle can be different. Furthermore, by modifying the shape of the cam 58, the return to the initial function may be done directly after having selected the third function.

In another alternative embodiment that is not shown, the selector organ may be a shuttle system, replacing the cam wheel. The shuttle is arranged to perform a rotational to-and-fro movement to occupy two positions set by a jumper-spring. The system makes it possible to eliminate the cam 58 and the lever 54. As described above, a feeler-spindle 60 is provided comprising a first arm 61 bearing against the shuttle and a second arm 62 for example mounted in a ball-joint connection or any other type of connection with the hollow 38 of the pivoting base 25. The position of the shuttle therefore also defines the position of the actuating device 4.

In reference to FIG. 1, the indicator mechanism for the selected function comprises a toothed wheel 66 secured to the cam 58 of the selector device 6, and a disc 68, mounted rotating on the frame and bearing information relative to the functions arranged so as to be displayed in turn in an aperture (not shown). The wheel 66 and the disc 68 are kinematically connected via an intermediate wheel 70 secured to the disc 68. The information relative to the functions here consists of numbers 1, 2, 3 corresponding to the three functions to be selected and actuated. The information could also assume any form other than numbers 1, 2, 3, such as colors or symbols. In another variant that is not shown, the disc 68 includes a toothing arranged to cooperate with the toothed wheel 66, the intermediate wheel 70 being eliminated. In another variant that is not shown, the wheel 66 does not include a toothing, and is kinematically connected to the disc 68 by means of other appropriate connecting means, such as belts or connecting-rods. Furthermore, it is possible to provide intermediate gear trains, between the wheel 66 and the disc 68, for example to reverse the rotation direction of the disc 68 or to further separate the display provided on the disc 68. Of course, any other embodiment for displaying information relative to the functions can be implemented. For example, the disc 68 can be replaced by a hand mounted on an axis kinematically connected to the wheel 66, the hand being arranged to point to the information relative to the functions located on a stationary dial.

Figure 3:
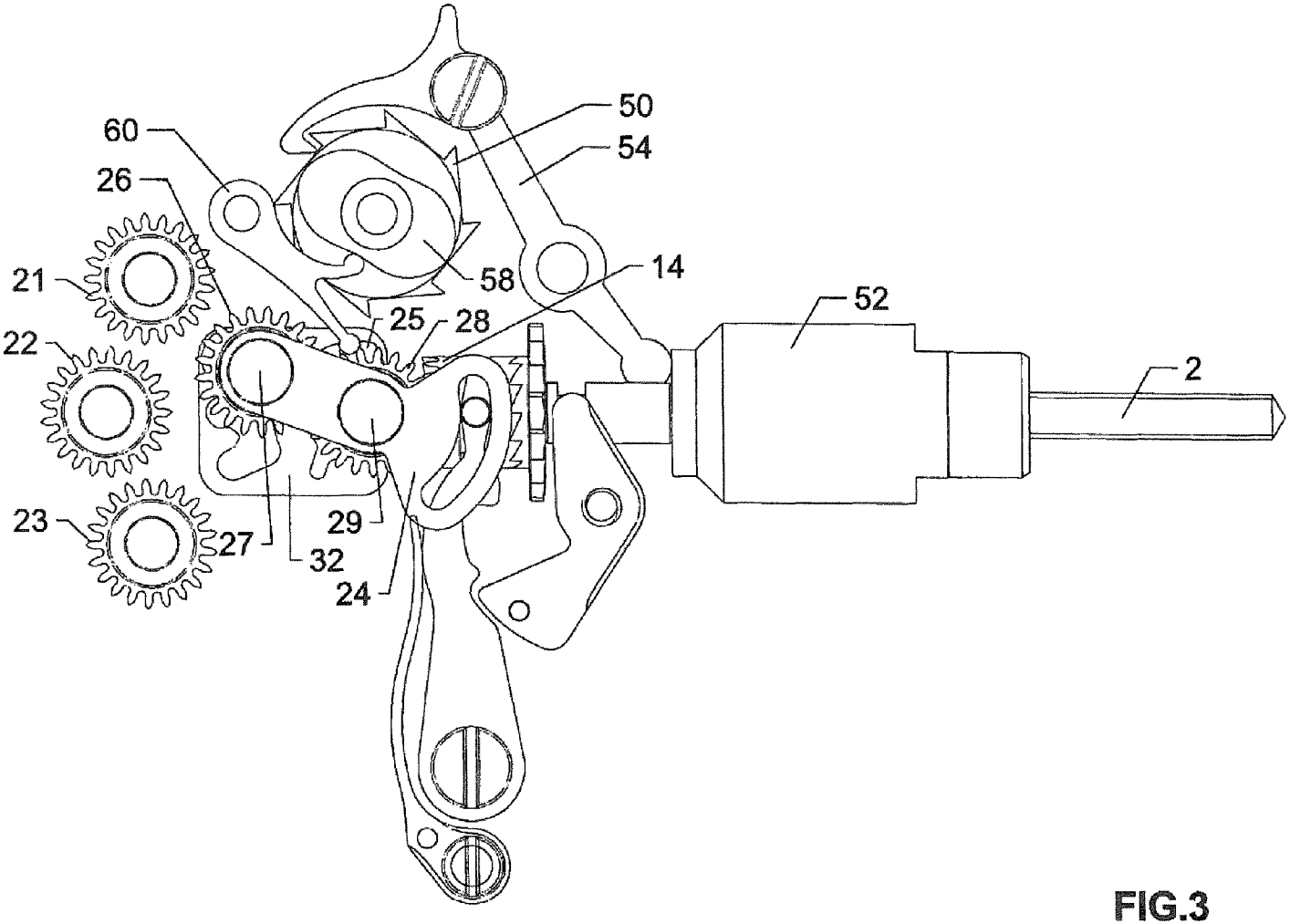
FIG. 3 shows a top view of the mechanism according to the invention in the position for selecting the first function.
Figure 4:
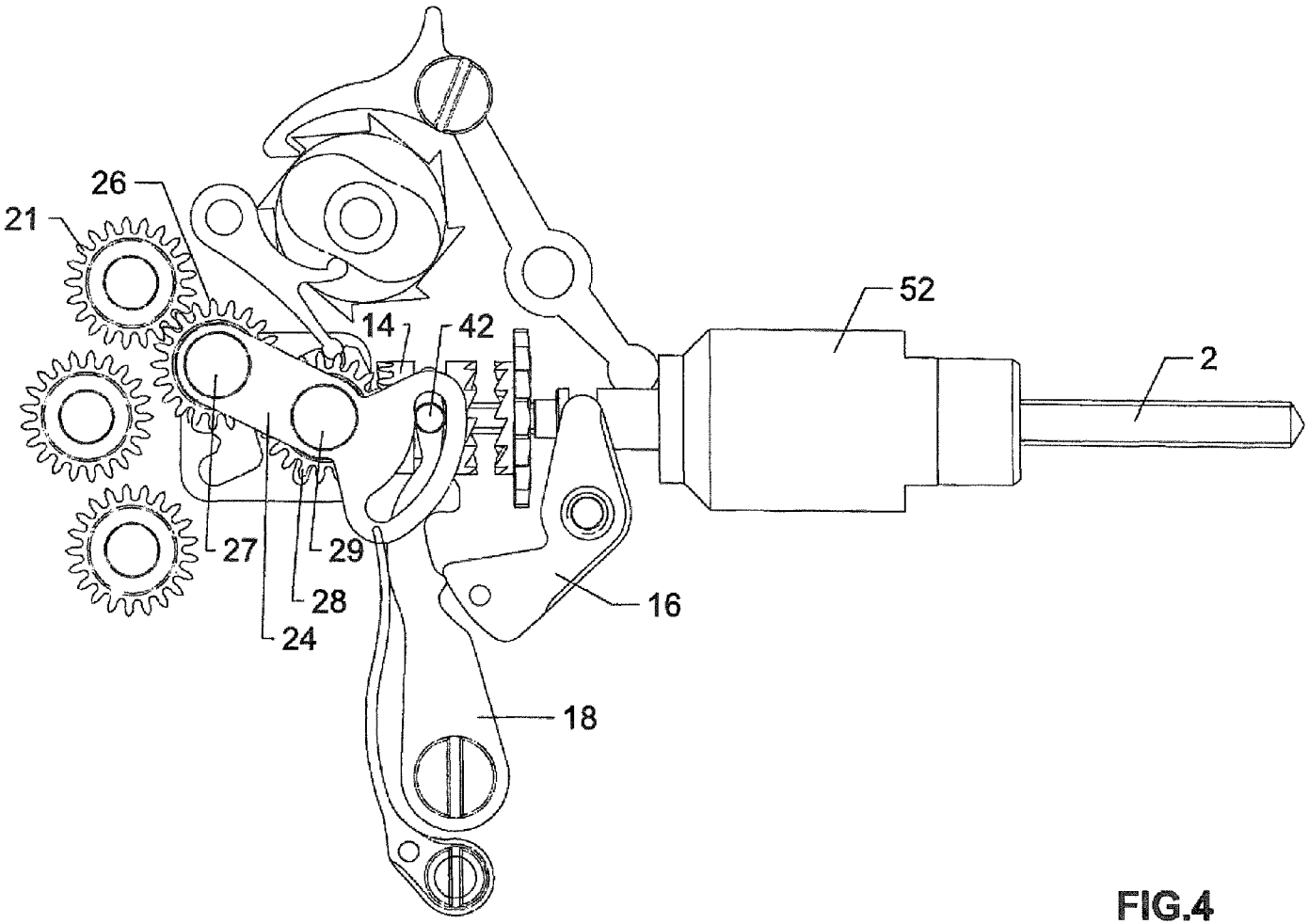
FIG. 4 shows a top view of the mechanism according to the invention in the position for actuating the first function.

The operation of the mechanism according to the invention is as follows:

In reference to FIGS. 3 and 4, when the user wishes to select function no. 1, he presses on the push-piece 52 so as to pivot the lever 54 into the position shown in dotted lines in FIG. 2, which causes the selector organ 50 and the cam 58 to rotate by 45° in the clockwise direction. The feeler-spindle 60 pivots while entraining the pivoting base 25, which arrives in selecting position no. 1, shown in FIG. 3. In the same movement, the support 24 of the actuating device, connected to the base 25 by pins 27 and 29, pivots with the base 25 to also be in selecting position no. 1 shown in FIG. 3, the wheel 26 being located facing the actuating organ 21 for function no. 1.

Also in that same movement, the first toothed wheel 66 of the mechanism indicating the selected function 10 pivots and meshes with the intermediate wheel 70 so as to rotate the second wheel 68 to display the number 1 in an aperture.

In order to actuate the actuating organ 21 relative to function no. 1, the user pulls the stem 2 toward the outside of the movement so that the clutch-pinion 14 moves. The positioning of the clutch-pinion 14 relative to the pull-out piece 16 and the lever 18 is a mechanism known by those skilled in the art that does not require further explanation.

Via the pin 42, the pivoting of the lever 18 also drives the sliding or movement of the support 24 relative to the base 25, toward the actuating organ 21. In this movement, the pin 27 slides in the opening 30 of the pivoting base 25 and becomes housed at the bottom of the first track 34 of the base 32 of the safety device, and the pin 29 moves linearly in the groove 36 of the split blom stud 33 of the base 32. As a result, the support 24 moves linearly, via the pin 29, as well as in the direction of the first track 34, via the pin 27. The movement of the support 24 is therefore a combination of linear and rotational movement. The actuating device 4 is then in actuating position no. 1, the wheel 26, supported by the support, then being able to mesh with said actuating organ 21, as shown in FIG. 4. Function no. 1 is actuated by rotating the winding crown, which drives the rotation of the clutch-pinion 14, and therefore of the intermediate wheel 28 and the wheel 26.

The support 24 is kept in actuating position no. 1 by the safety device using the pin 27 housed at the bottom of the track of the base 32.

Pressing the winding stem 2 in the direction of the movement drives the first sliding of the support 24, such that the wheel 26 is extricated from the actuating organ 21, the mechanism returning to selecting position no. 1 shown in FIG. 3.

Figure 5:
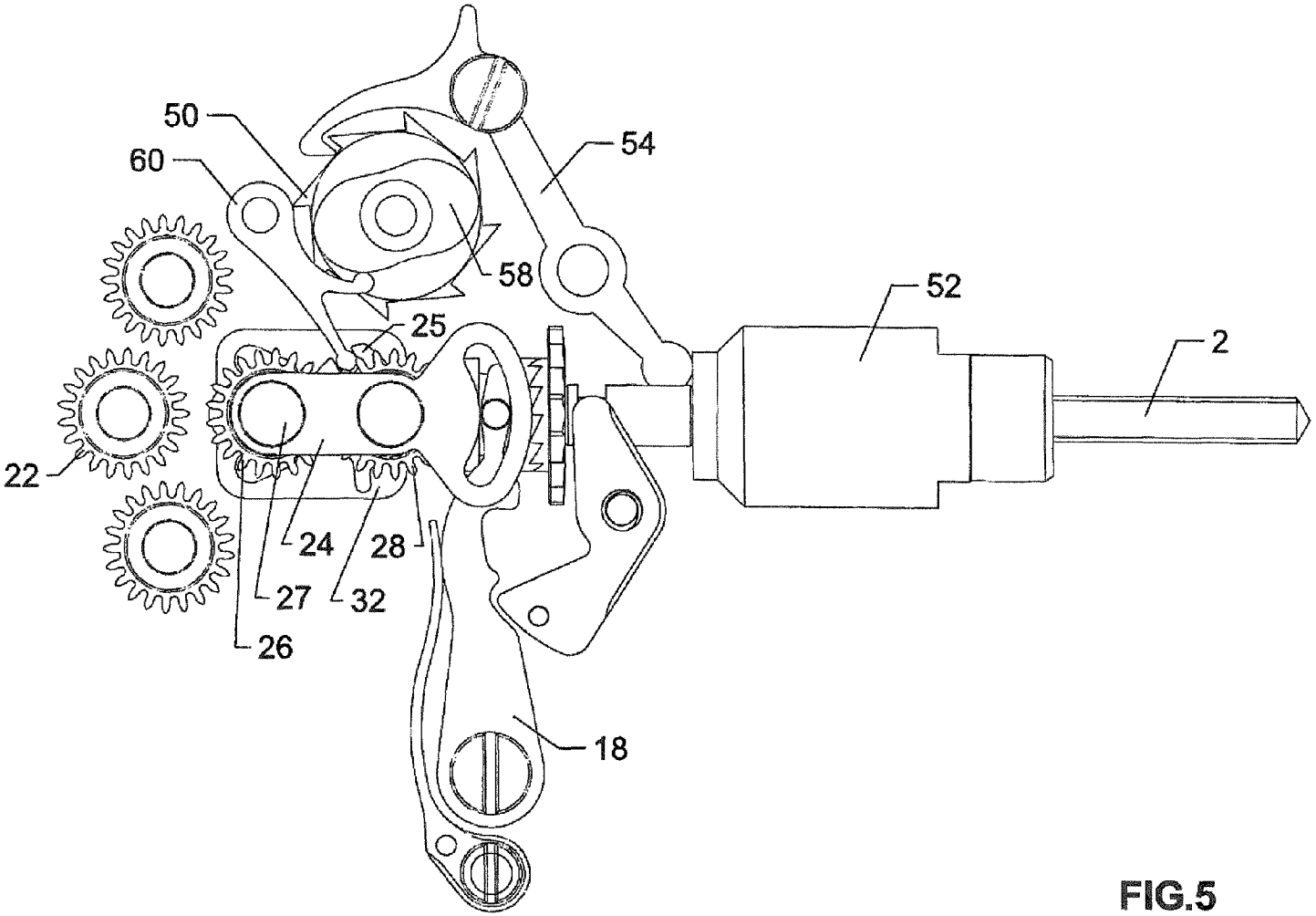
FIG. 5 shows a top view of the mechanism according to the invention in the position for selecting the second function.
Figure 6:
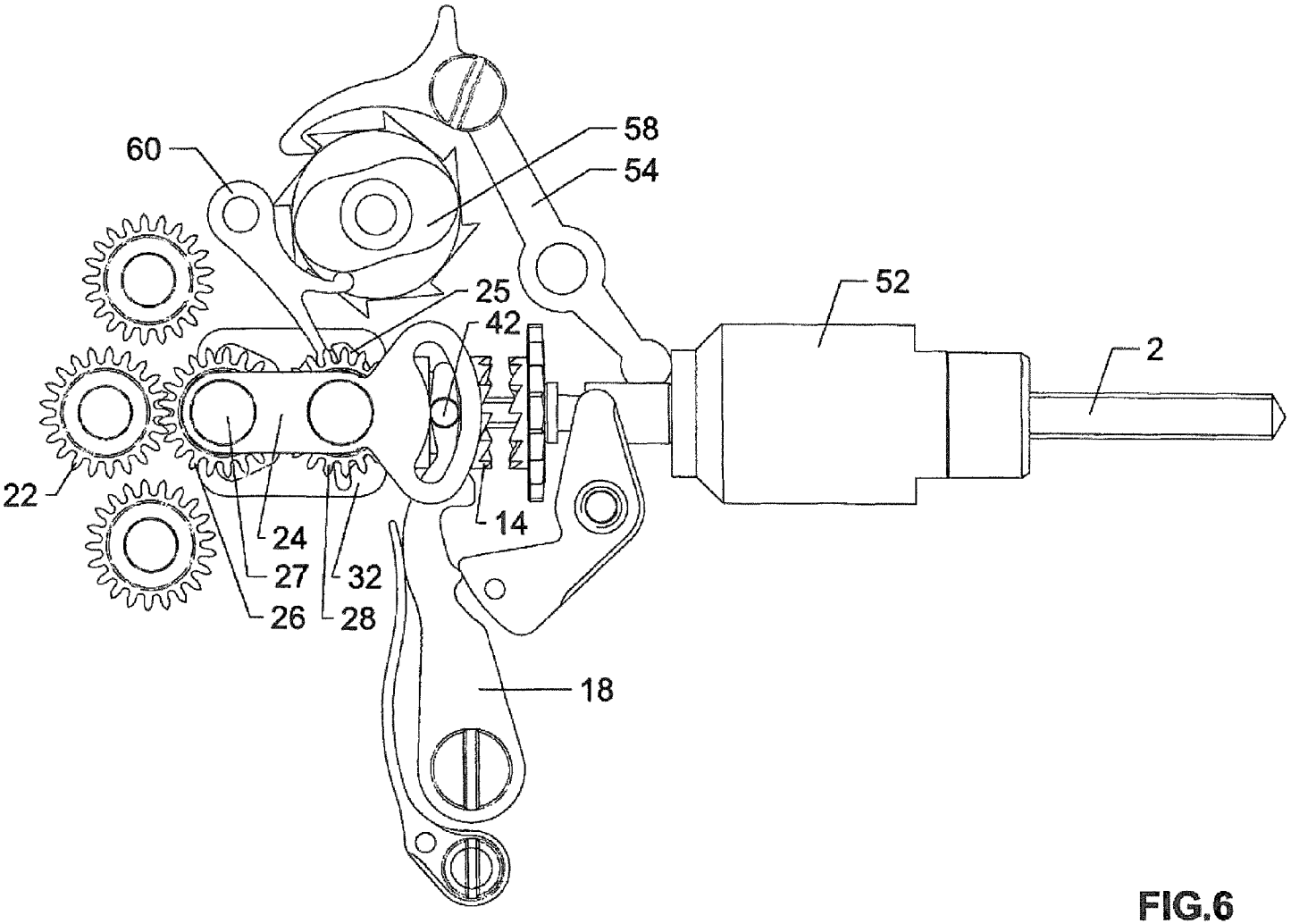
FIG. 6 shows a top view of the mechanism according to the invention in the position for actuating the second function.

In reference to FIGS. 5 and 6, when the user wishes to select function no. 2, he presses on the push-piece 52 so as to pivot the lever 54, which once again causes the selector organ 50 and the cam 58 to rotate by 45° in the clockwise direction. The feeler-spindle 60 pivots by rotating the pivoting base 25, which reaches selecting position no. 2 shown in FIG. 2. In that same movement, the support 24 of the actuating device pivots with the base 25 so as also to be placed in selecting position no. 2 shown in FIG. 5, the wheel 26 being located facing the actuating organ 22 for function no. 2.

Also in that same movement, the first toothed wheel 66 of the indicator mechanism for the selected function 10 pivots and meshes with the intermediate wheel 70 so as to rotate the second wheel 68 to display the number 2 in an aperture.

In order to actuate the actuating organ 22 relative to function no. 2, the user pulls the stem 2 toward the outside of the movement such that, as described above, the support 24 slides relative to the base 25, toward the actuating organ 22. In that movement, the pin 27 slides in the opening 30 of the pivoting base 25 and becomes housed at the bottom of the second track 34 of the base 32 of the safety device. The pins 27 and 29 being in the axis of the second track 34, the movement of the actuating device 4 is a simple linear movement. The actuating device 4 is then in actuating position no. 2, the wheel 26, carried by the support 24, then being able to mesh with said actuating organ 22 as shown in FIG. 6. Function no. 2 is actuated by rotating the winding crown, which drives the rotation of the clutch-pinion 14, and therefore of the intermediate wheel 28 and the wheel 26.

The support 24 is kept in actuating position no. 2 by the safety device using the pin 27 housed at the bottom of the track of the base 32.

Pressing the winding stem 2 in the direction of the movement causes reverse sliding of the support 24, such that the wheel 26 is extricated from the actuating organ 22, the mechanism returning to selecting position no. 2 shown in FIG. 5.

Figure 7:
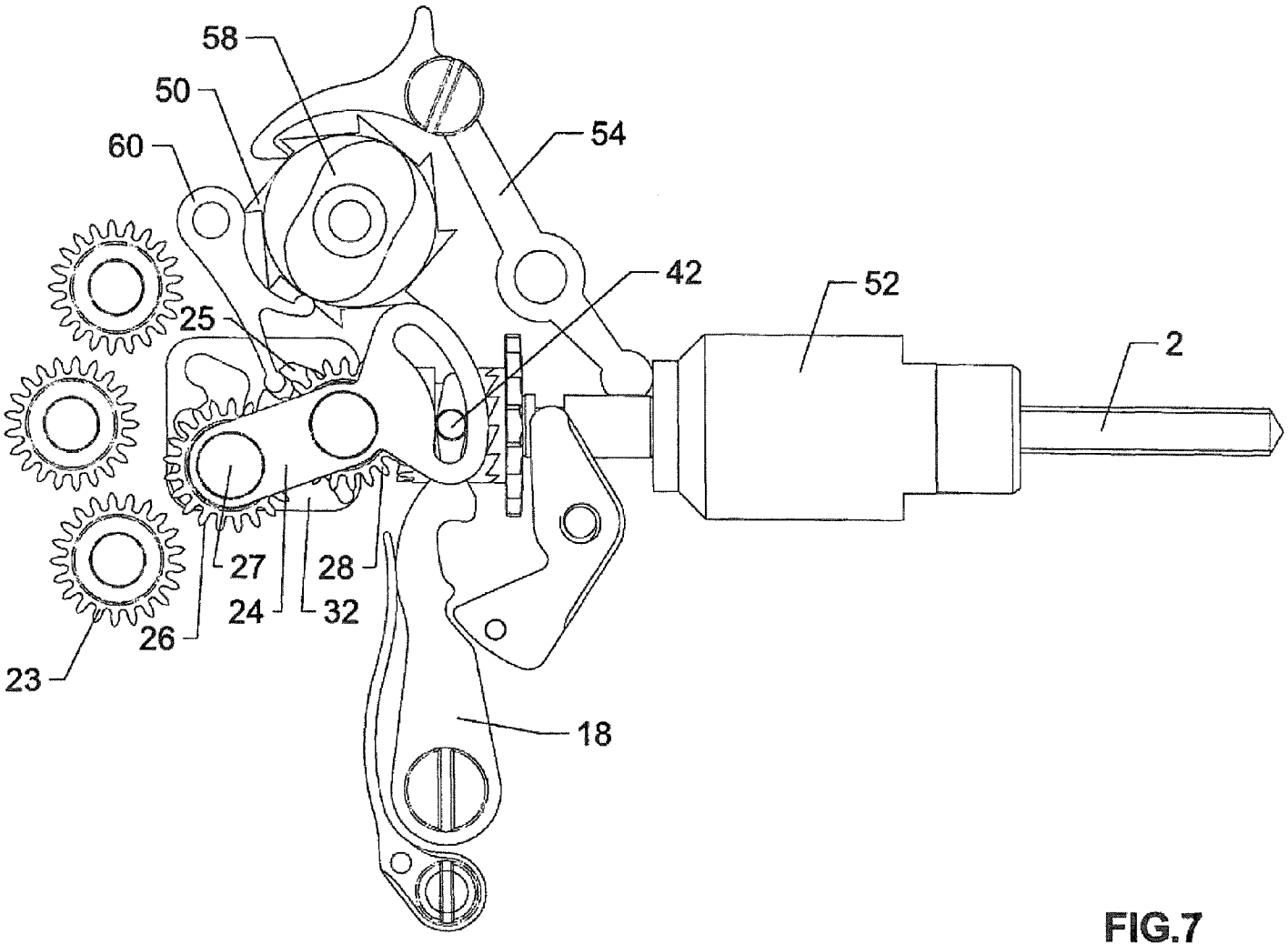
FIG. 7 shows a top view of the mechanism according to the invention in the position for selecting the third function.
Figure 8:
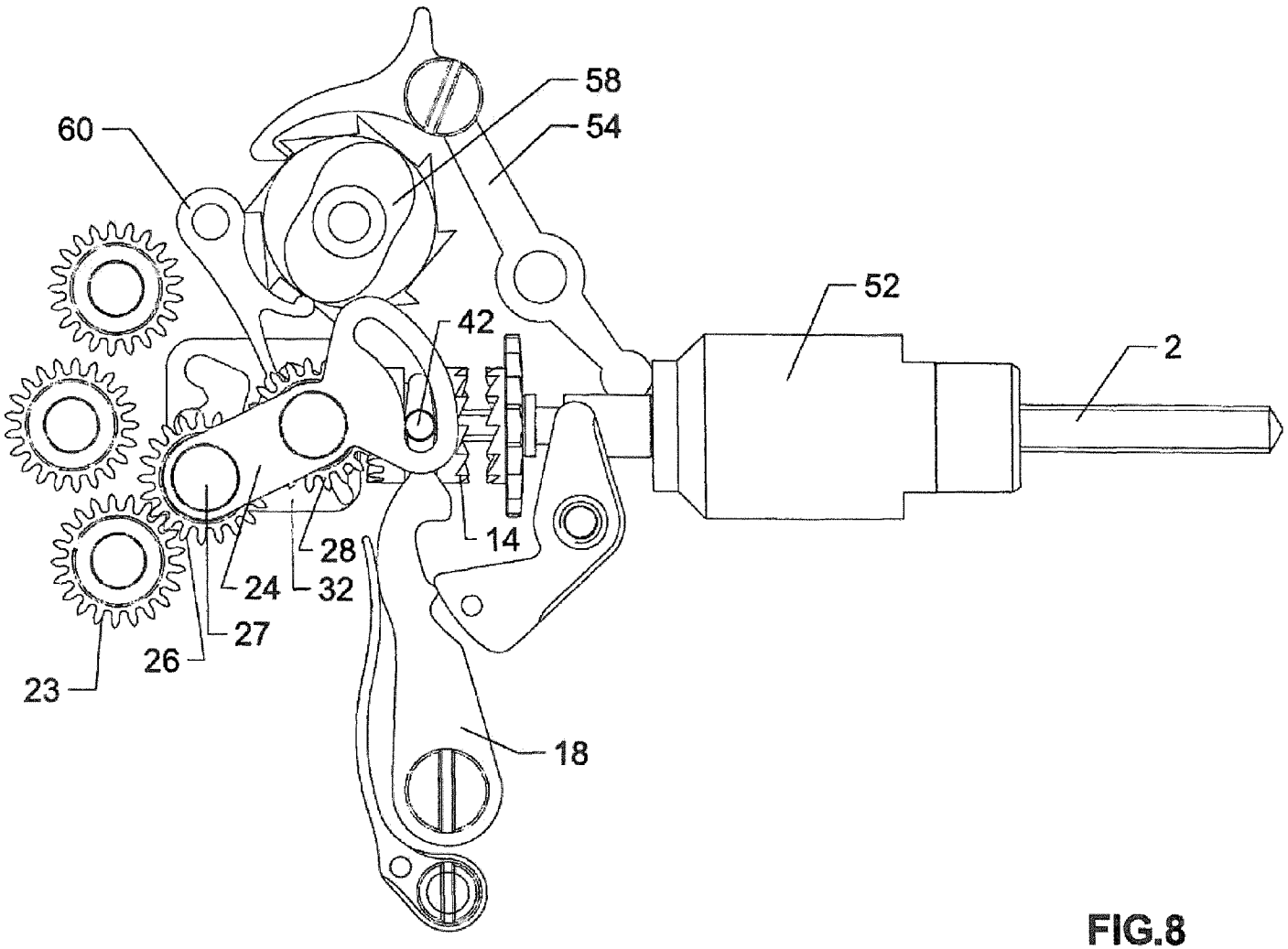
FIG. 8 shows a top view of the mechanism according to the invention in the position for actuating the third function.

In reference to FIGS. 7 and 8, when the user wishes to select function no. 3, he presses on the push-piece 52 so as to pivot the lever 54, which once again causes the selector organ 50 and the cam 58 to rotate by 45° in the clockwise direction. The feeler-spindle 60 pivots while driving the rotation of the pivoting base 25, which enters selecting position no. 3 shown in FIG. 7. In that same movement, the support 24 of the actuating device pivots with the base 25 so as also to reach selecting position no. 3 shown in FIG. 7, the wheel 26 being located facing the actuating organ 23 for function no. 3.

Also in that same movement, the first toothed wheel 66 of the indicator mechanism for the selected function 10 pivots and meshes with the intermediate wheel 70 so as to rotate the second wheel 68 to display the number 3 in an aperture.

In order to actuate the actuating organ 23 relative to function no. 3, the user pulls the stem 2 toward the outside of the movement so that, as described above, the support 24 slides relative to the base 25, toward the actuating organ 23. In that movement, the pin 27 slides in the opening 30 of the pivoting base 25 and becomes housed at the bottom of the third track 34 of the base 32 of the safety device. The actuating device 4 is then in actuating position no. 3, the wheel 26, supported by the support 24, then being able to mesh with said actuating organ 23 as shown in FIG. 8. Function no. 3 is actuated by rotating the winding crown, which drives the rotation of the clutch-pinion 14, and therefore of the intermediate wheel 28 and the wheel 26.

The support 24 is kept in actuating position no. 3 by the safety device using the pin 27 housed in the bottom of the track of the base 32.

Pressing the winding stem 2 toward the movement drives the reverse sliding of the support 24, such that the wheel 26 is extricated from the actuating organ 23, the mechanism returning to selecting position no. 3 shown in FIG. 7.

Pressing the push-piece 52 again causes the lever 54 to pivot, which once again causes the selector organ 50 and the cam 58 to rotate by 45° in the clockwise direction. The mechanism is then returned to selecting position no. 2.

The mechanism according to the present invention has the advantage of being bidirectional.

Of course, the present invention is not limited to the embodiment described above. In particular, the number of functions to be selected and actuated is not limited to three. In fact, it suffices to adapt the travel of the actuating device during its various rotations to enter selecting positions, in the number of actuating organs to be selected. Likewise, the rotation direction of the selector organ 50 and the cam 58 can be opposite the directions indicated in the described variant, by making the necessary modifications within the reach of one skilled in the art.

Figure 9:
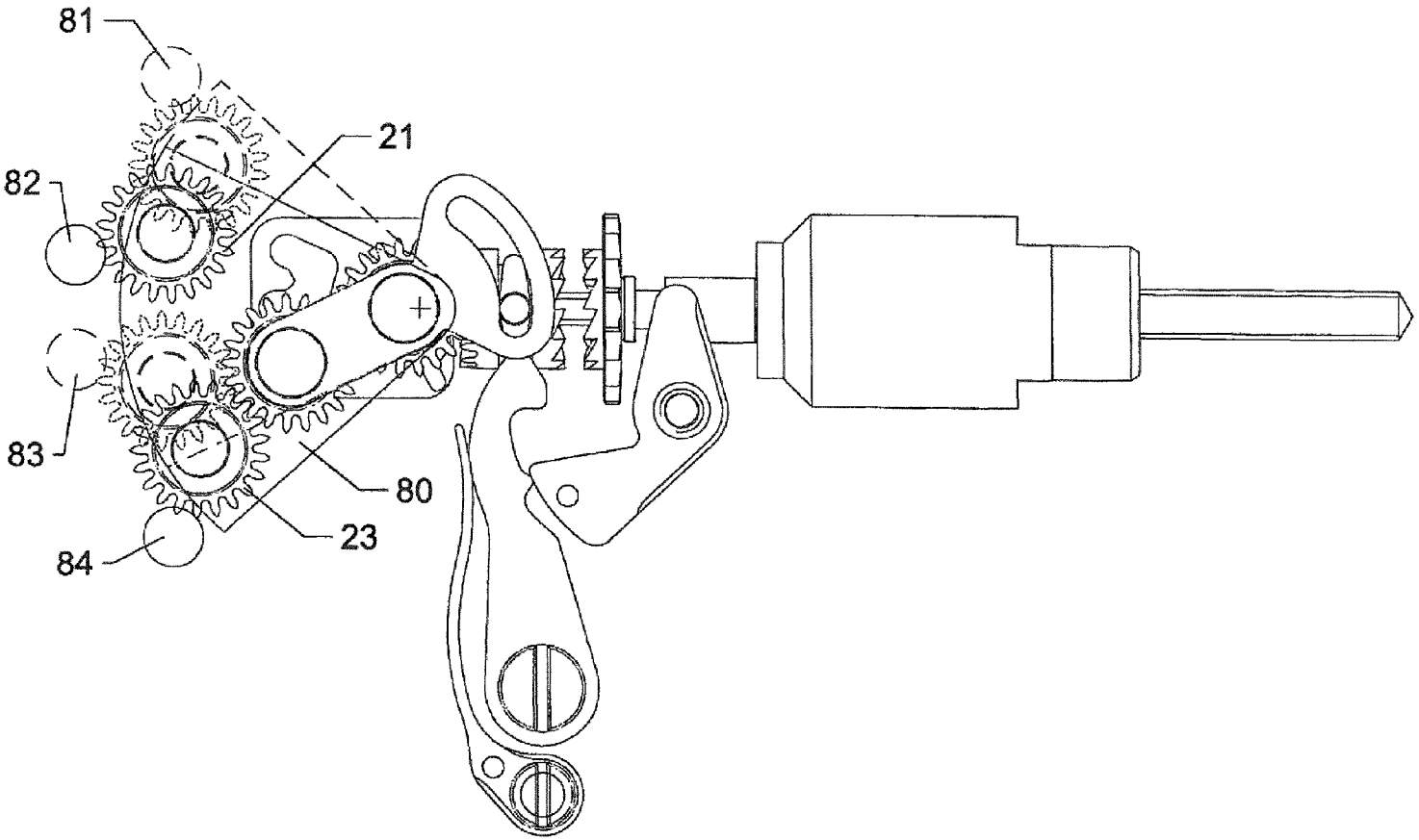
FIG. 9 shows a top view of the mechanism according to the invention according to another alternative embodiment.

Another alternative embodiment making it possible to increase the number of functions to be selected and actuated is shown in FIG. 9. In this variant of the invention, a carriage 80 is also provided mounted pivoting on the frame. The primary actuating organs 21, 22, 23 are mounted pivoting on said carriage 80. To avoid overloading FIG. 9, only the primary actuating organs 21 and 23 are shown. An actuating mechanism (not shown) is also provided that is arranged to pivot the carriage 80. Such a mechanism is for example a push-piece or a trigger. The carriage 80 can for example be arranged to occupy two positions, such that each primary actuating organ 21, 22, 23 can also occupy two actuating positions. Also provided are secondary actuating organs arranged to actuate the selected function, each being kinematically connected to the mechanism corresponding to said selected function. Furthermore, the secondary actuating organs are arranged to be actuated by the primary actuating organs when the latter are located facing the secondary actuating organs. In FIG. 9, only the secondary actuating organs 81, 82, 83, 84 are shown. The secondary actuating organs 81 and 82 are arranged to cooperate with the primary actuating organ 21 and the secondary actuating organs 83 and 84 are arranged to cooperate with the primary actuating organ 23. Thus, when the carriage 80 is located in the position shown in solid lines in FIG. 9, the primary actuating organ 21 can actuate the secondary actuating organ 82 and the primary actuating organ 23 can actuate the secondary actuating organ 84, based on the position of the actuating device 4. When the carriage 80 is moved by a user and located in the position shown in dotted lines in FIG. 9, the primary actuating organ 21 can actuate the secondary actuating organ 81 and the primary actuating organ 23 can actuate the secondary actuating organ 83, based on the position of the actuating device 4. As a result, in the configuration with three primary actuating organs each able occupy two actuating positions, it is possible to actuate six secondary actuating organs, corresponding to six functions using only a winding crown with a push-piece and a control organ of the actuating mechanism of the carriage 80.

Another alternative embodiment making it possible to increase the number of functions to be selected and actuated is to provide tracks on the support, the shape of said tracks being chosen to allow dual positioning of the support, and therefore of the actuating device.

Another alternative embodiment making it possible to increase the number of functions to be selected and actuated is to provide a carriage similar to the carriage 80 bearing the primary actuating organs, but moving not in an arc of circle as shown in FIG. 9, but in translation in front of the secondary actuating organs. Also provided is an actuating mechanism arranged to move that carriage. In that case, the center distances between the actuating wheel 26 and each of the primary actuating organs 21, 22 and 23 must be adapted so as to offset the difference in penetration depth between the actuating wheel 26 and either of the primary actuating organs 21, 22, 23. It is possible, for example, to provide a mechanism connected to the carriage that would make it possible to act on the movement of the lever 18, so that it moves by a different distance toward the inside of the movement depending on the position of carriage.

The shape of the cam and the choice of the functions to be selected and actuated may also be modified without going beyond the scope of the present invention. Furthermore, the mechanism can be adapted so that the selector organ 50 rotates in the counterclockwise direction, the clockwise direction corresponding to the alternative described here.

The invention claimed is:

1. A mechanism for selecting and actuating n functions of a clockwork movement, where n is an integer greater than or equal to 1, comprising a winding stem ending with a crown, a device for actuating a function, kinematically connected to the crown and arranged to move and occupy n selecting positions and n actuating positions, in which actuating positions the actuating device is kinematically connected to an organ for actuating the selected function, and a selector device arranged to move the actuating device into a selecting position, said selecting positions being different from said actuating positions, wherein said mechanism further comprises a base on which the actuating device is movably mounted to move and be positioned, in a selecting position, facing the organ for actuating the selected function under the action of the selector device, and to move into its actuating position to cooperate with said organ for actuating the selected function under the action of axial movement of the winding stem.

2. The mechanism according to claim 1, wherein the actuating device comprises a single actuating wheel kinematically connected to the winding stem and intended to cooperate with each of the organs for actuating the selected function.

3. The mechanism according to claim 2 wherein the actuating device further comprises at least one intermediate wheel arranged to cooperate on the one hand with the winding stem and on the other hand with said actuating wheel, a support on which said intermediate wheel and the actuating wheel are rotatably mounted, and a pivoting base arranged to cooperate with the selector device and on which the support is slidingly mounted.

4. The mechanism according to claim 3, wherein said support is arranged to cooperate with a lever.

5. The mechanism according to claim 1, wherein the selector device comprises a selector organ arranged to be actuated by a control organ, a cam secured to said selector organ and a feeler-spindle arranged to cooperate on the one hand with the cam and on the other hand with the actuating device.

6. The mechanism according to claim 5, wherein the feeler-spindle comprises an arm arranged to cooperate with the base of the actuating device.

7. The mechanism according to claim 5, wherein said control organ is a push-piece integrated into the crown.

8. The mechanism according to claim 1, wherein said base has at least n tracks arranged to guide the actuating device during its movements.

9. The mechanism according to claim 8, wherein the base further comprises a groove and in that the actuating device comprises a first pin arranged to travel in the tracks and a second pin arranged to travel in the groove.

10. The mechanism according to claim 8, wherein it comprises a safety device comprising said base and said tracks, at least n of said tracks corresponding to the actuating positions being arranged to lock the actuating device in the selected actuating position.

11. The mechanism according to claim 1, wherein it comprises a mechanism for indicating the selected function.

12. The mechanism according to claim 11, wherein said indicator mechanism of the selected function comprises a wheel secured to the cam of the selector device, and a disc bearing information relative to the functions and arranged to be displayed in an aperture, said wheel and said disc being kinematically connected.

13. The mechanism according to claim 1, wherein the functions to be selected are chosen from among the group comprising a date correction function, a winding function and a setting function.

14. A timepiece comprising a clockwork movement, wherein it comprises a mechanism for selecting and actuating n functions of said clockwork movement according to claim 1.

15. The mechanism according to claim 1, where n is greater than or equal to two.

16. The mechanism according to claim 1, where n is greater than or equal to three.

* * * * *